United States Patent [19]

Focke

[11] Patent Number: 4,843,800

[45] Date of Patent: Jul. 4, 1989

[54] PROCESS AND APPARATUS FOR SEALING FOLDING TABS OF A PACK

[75] Inventor: Heinz Focke, Verden, Fed. Rep. of Germany

[73] Assignee: Focke & Co., (GmbH & Co.), Verden, Fed. Rep. of Germany

[21] Appl. No.: 116,815

[22] Filed: Nov. 5, 1987

[30] Foreign Application Priority Data

Nov. 12, 1986 [DE] Fed. Rep. of Germany ..... 3638627

[51] Int. Cl.[4] ..... B65B 19/02; B65B 51/14

[52] U.S. Cl. ..... 53/477; 53/379; 53/388

[58] Field of Search ..... 53/477, 379, 388, 209, 53/203; 219/388; 156/498, 583.8, 583.1

[56] References Cited

U.S. PATENT DOCUMENTS

| | | | |
|---|---|---|---|
| 3,166,462 | 1/1965 | Schoder | 53/477 X |
| 3,200,555 | 8/1965 | Liedtke | 53/477 X |
| 3,236,027 | 2/1966 | Schmermund | 53/379 X |
| 3,431,398 | 3/1969 | Wahle | 53/379 X |
| 3,844,872 | 10/1974 | Lenoir et al. | 53/379 X |
| 4,671,045 | 6/1987 | Anderson | 53/477 X |

FOREIGN PATENT DOCUMENTS

| | | |
|---|---|---|
| 1136265 | 9/1962 | Fed. Rep. of Germany . |
| 1169835 | 5/1964 | Fed. Rep. of Germany . |
| 2509996 | 10/1975 | Fed. Rep. of Germany . |
| 2528594 | 1/1976 | Fed. Rep. of Germany . |
| 2528607 | 1/1976 | Fed. Rep. of Germany . |
| 2528631 | 1/1976 | Fed. Rep. of Germany . |
| 2528632 | 1/1976 | Fed. Rep. of Germany . |
| 2623598 | 12/1977 | Fed. Rep. of Germany . |
| 2900615 | 7/1979 | Fed. Rep. of Germany . |
| 2910404 | 9/1980 | Fed. Rep. of Germany . |
| 3334856 | 4/1984 | Fed. Rep. of Germany . |
| 3335310 | 4/1984 | Fed. Rep. of Germany . |
| 3400650 | 7/1985 | Fed. Rep. of Germany . |
| 1489608 | 7/1967 | France . |
| 585127 | 2/1977 | Switzerland . |
| 1132422 | 10/1968 | United Kingdom . |
| 1154629 | 6/1969 | United Kingdom . |
| 2045678 | 11/1980 | United Kingdom . |

OTHER PUBLICATIONS

"Dubbel" Publication, W. Beitz et al., New York, 1983.

*Primary Examiner*—James F. Coan
*Attorney, Agent, or Firm*—Sughrue, Mion, Zinn, Macpeak, and Seas

[57] ABSTRACT

Packs (10), in the present case cigarette packs, are often wrapped in blanks which consist of sealable material. Folding tabs, for example tubular tabs, side tabs (14, 15) and longitudinal tabs (16, 17), are connected to one another by means of sealing, with heat and pressure being applied.

It is intended, despite the high working speed of the packaging machines and of the conveying members of these, that sealing should be carried out accurately and as tightly as possible.

For this purpose, sealing members, in particular sealing jaws (41) for tubular tabs and sealing jaws (45, 46) for side tabs (14, 15) on longitudinal tabs (16, 17), are provided in the region of end faces (11, 12), and these execute extremely short stroke movements between a sealing position during a standstill phase of the packs (10) and a retracted position. In the last-mentioned position, during which the packs are transported further intermittently, the sealing jaws (41; 45, 46) rest with only slight pressure against the packs (10) sliding past, as a result of which sealing is stabilized and folding tabs are smoothed. Altogether, very accurate and highly impermeable sealing is achieved in this way.

23 Claims, 8 Drawing Sheets

PROCESS AND APPARATUS FOR SEALING FOLDING TABS OF A PACK

BACKGROUND OF THE INVENTION

The invention relates to a process and an apparatus for sealing folding tabs of a pack (cigarette pack) wrapped in a sealable blank, by means of heated sealing members which, during a standstill phase of the packs conveyed intermittently, can be pressed against these in the region of the folding tabs (sealing cycle).

In the sealing of folding tabs of packaging blanks, that is to say the connection of such folding tabs to one another by thermal welding, there is the problem, on high-speed packaging machines, of carrying out the welding of the folding tabs within the extremely short sealing times available (sealing cycle), in such a way that they are connected to one another as accurately and as tightly as possible, but the packaging material and the pack itself are not damaged. On packaging machines for cigarette packs, the cycle times are extremely short. The sealing of the outer wrapping consisting of plastic films (polyethylene, etc.) has to be carried out accurately within the shortest possible time. The present invention is mainly concerned with the finishing and sealing of such outer wrappings of cigarette packs.

SUMMARY OF THE INVENTION

The object on which the invention is based is to carry out the sealing of folding tabs accurately and with great care within the shortest possible sealing-cycle times, at the same time ensuring that the seal has increased impermeability.

To achieve this object, the process according to the invention is characterized in that at least the transmission of heat to the folding tabs is maintained between the sealing cycles, during the transport of the packs.

Whereas hitherto the sealing members, especially sealing jaws, have executed a relatively large stroke after the completion of a sealing cycle, in order to assume a position at a clear distance from the sealed folding tabs (approximately 5 mm), according to the invention a certain contact between the sealing jaws or sealing faces of these and the folding tabs is maintained even during the time between the sealing cycles, that is to say even during the further transport of the packs. For this purpose, in the invention the sealing jaws execute only very small strokes, in particular of approximately 1 mm. As a result, not only is there a reduction in the amount of time required for actuating the sealing jaws, but on the contrary the packs, together with the sealed folding tabs, slide along on the sealing faces of the sealing jaws with slight contact, during further transport. Thus, smoothing and additional sealing take place even during further movement.

On the one hand, this ensures extremely accurate crease-free sealing ensuring a smooth surface. The folding tabs are connected to one another substantially over their entire surface, thus considerably increasing the impermeability of the fold. Also, the maximum sealing temperature and/or the sealing pressure can be reduced during the sealing cycle, since, overall, the sealing temperature and (light) pressure are transmitted to the folding tabs for a longer period of time. The stroke of the sealing jaws takes account of the fact that the packs have a ceratin dimensional elasticity, that is to say are compressed slightly during the sealing cycle and expand when pressure is removed.

According to a further proposal, presealing of folding tabs folded first is carried out. In particular, an inner longitudinal tab is attached, by means of presealing, to blank parts which are likewise already folded and which are located partially under the longitudinal tab. The initially unstable fold is thereby fixed, so that there can be no change in the relative position during the further transport and completion of the folds.

Outer wrappings of cigarette packs are conventionally folded in such a way that a tubular overlap is formed in the region of a narrow side face. According to the invention, the tubular tabs partially overlapping one another are sealed in the region of a conveying stage directed upwards, specifically by means of a sealing member which is common to several packs resting on top of one another and which can be advanced, likewise with a short stroke (approximatley 1 mm), towards the side faces of the packs. Thus, here too, the sealing jaw exerts a smoothing and additional sealing effect during the transport of the packs.

On a horizontal pack track, folding tabs are folded in the region of laterally directed end faces of the cigarette packs. Arranged on both sides of the pack track are sealing jaws which extend over a dimension corresponding to several packs located next to one another in the conveying direction, preferably two respective packs being arranged above one another. At the same time, the sealing jaws are equipped with adjacent sealing elevations which are each assigned to one end face of a pack and which ensure that each end face takes effect at a slight distance from the margin of the respective end face. The dimensionally stable and essentially rigid edges at the margin of the end faces are therefore not subjected to pressure at the sealing members.

To prevent the packs sealed in the region of several faces from adhering to one another, according to the invention measures are taken, after the sealing of the folding tabs, to separate the packs from one another as a result of a short relative movement, especially as a result of a brief shift transverse to the conveying direction.

Further details of the invention relate to the process for sealing folding tabs and to the apparatus for carrying out the process. An exemplary embodiment of the apparatus is explained in detail below with reference to the drawings.

DETAILED DESCRIPTION OF A PREFERRED EMBODIMENT

The apparatus described below serves for the (completion) folding and sealing of packs 10 for cigarettes this being the preferred sector of use. In particular, they are packs of the hinge-lid type. These packs 10 which are relatively stable in terms of their dimensions are equipped with an outer wrapping consistino of a sealable film (polyethylene film). Folding tabs of these are fixed by means of sealing. It is important to ensure that these folding tabs are connected to one another as exactly as possible and, above all, as tightly as possible.

In the present exemplary embodiment the outer wrapping of the packs 10 is formed, as is known in packaging technology, by first folding an appropriate film blank round the pack 10 in a U-shaped manner, specifically in such a way that tubular tabs (not shown) partially overlapping one another are obtained in the region of a narrow side face 11 of the pack. These must be connected to one another by means of sealing over the entire length of the side face 11.

Figure 1:
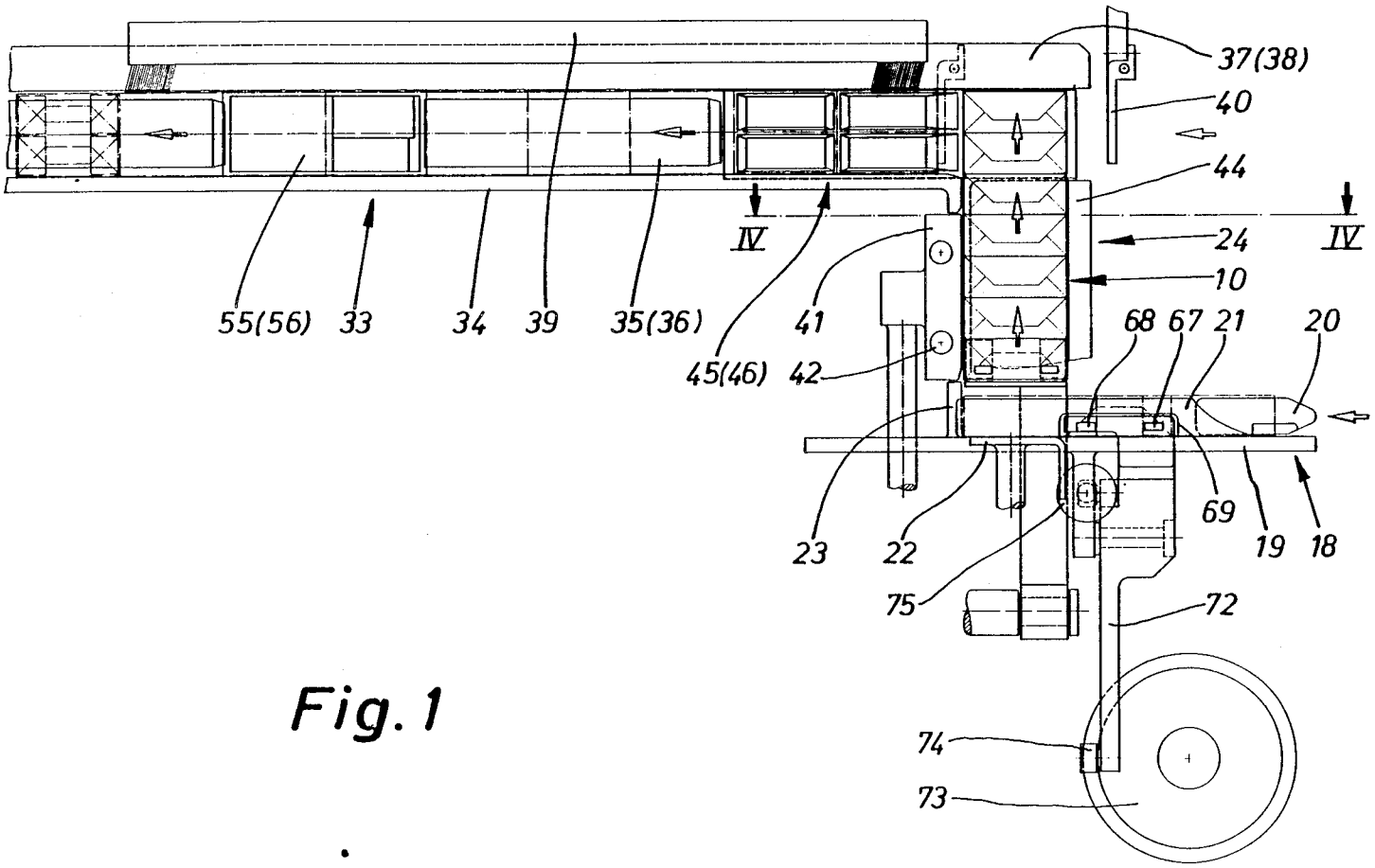
FIG. 1 shows a diagrammatic side view of an apparatus for sealing the outer wrapping of (cigarette) packs.
Figure 2:
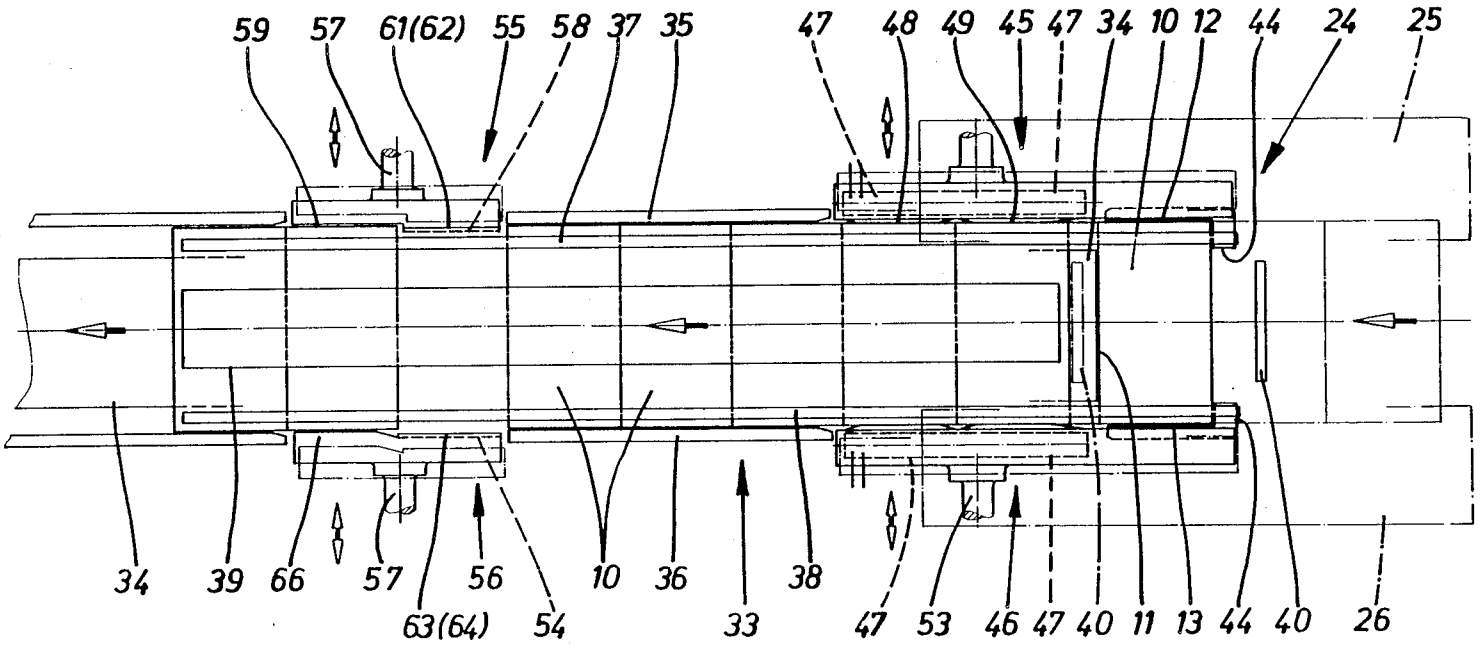
FIG. 2 shows a plan view of FIG. 1.
Figure 3:
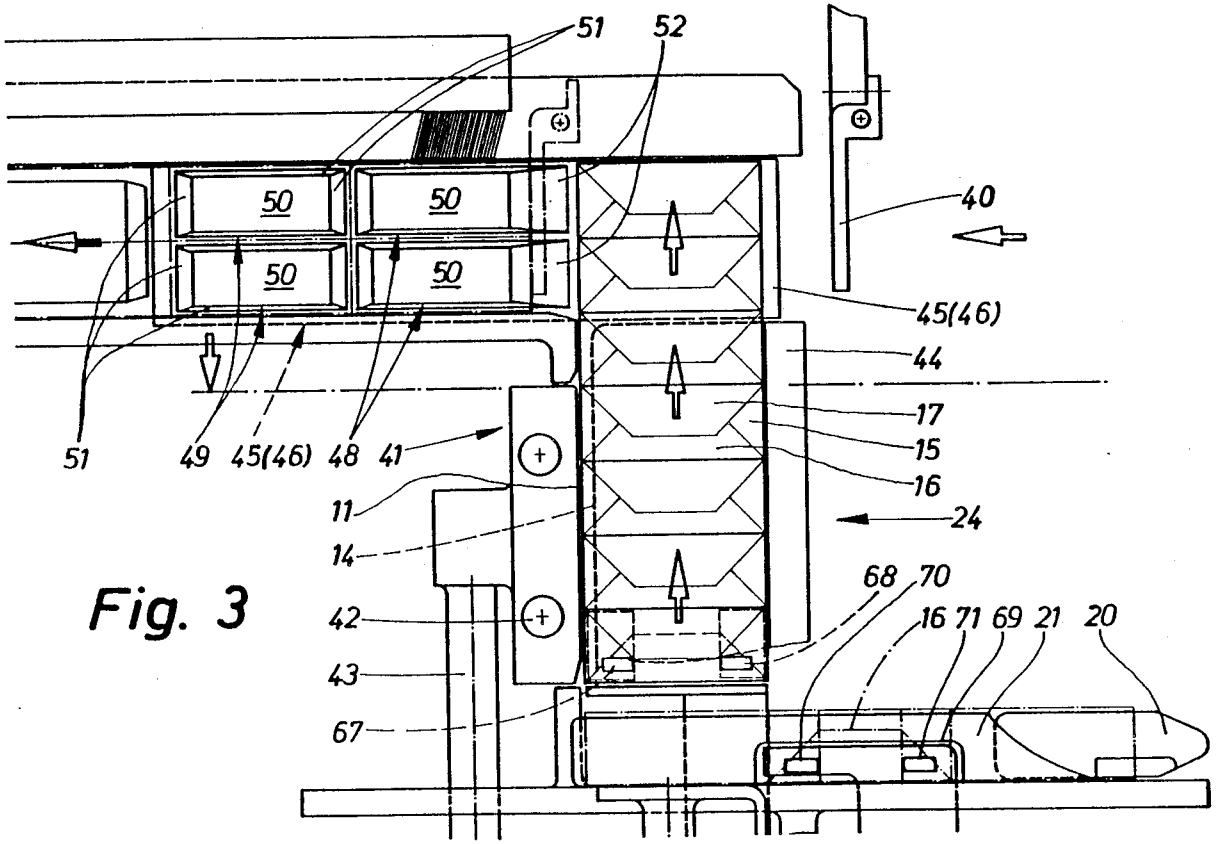
FIG. 3 shows a cut-out from the illustration according to FIG. 1 on an enlarged scale.

Other forms of folding tabs are obtained in the region of (upper and lower) end faces 12 and 13 of the packs 10. As is evident especially from FIG. 3, the parts of the outer wrapping which initially project beyond the pack 10 here are folded in the manner of an envelope, so as to produce side tabs 14 and 15 (folded first) which are folded from the narrow side face 11 against the end face 12, 13. Trapezoidal inner longitudinal tabs 16 and outer longitudinal tabs 17 are folded onto these in succession, specifically starting from the front side and rear side of the pack 10. The side tabs 14, 15 and the longitudinal tabs 16, 17 partially overlapping one another must likewise be connected to one another by means of sealing.

The packs 10, together with the outer wrapping already partially folded, are fed on a lower conveyor track 18 to the apparatus shown here. Arranged on an supporting plate 19 are lateral folding members, in particular folding cams 20 and folding switches 21, by means of which first the side tabs 14 located at the front in the conveying direction and then lower inner longitudinal tabs 16 are folded. The side tab 15 located at the rear in the conveying direction is already folded before the pack 10 enters the region of the supporting plate 19. The folding members described and the execution of the folding operations are also known in packaging technology.

The pack 10 is conveyed, on the supporting plate 19, into the region of an elevator 22 movable up and down. The exact position of the packs 10 in the conveying direction is determined by a position stop 23 arranged on the supporting plate 19.

The elevator conveys the packs 10 into a vertical conveying tower 24 individually and in succession. To allow the elevator 22 to pass through the supporting plate 19, the latter can be provided with a recess in the region underneath the conveying tower 24 or, as in the present exemplary embodiment, consist as a whole of two lateral supporting rails 25, 26 arranged at a distance from one another. The elevator 22 can be moved through between these.

The conveying tower 24 consists of two lateral guide walls 27, 28 which are located opposite one another and which extend in the region of the laterally directed end faces 12, 13 of the packs 10. The guide walls 27, 28 or their lower edges 29 at the same time perform the function of a folding member. When a pack 10 enters the region of the guide walls 27, 28, the upper or outer longitudinal tabs 17, hitherto still projecting transversely, are folded round against the end faces 12, 13.

As lower supporting members for the packs 10 resting on top of one another in the conveying tower 24, there are supporting fingers 30, 31 which can be introduced into the region of the conveying tower 24 from the sides of the guide walls 27, 28 as a result of a transverse movement, in such a way that the particular pack 10 at the bottom is held and supported at its end faces. The supporting fingers 30, 31, which are horizontally in the supporting position, are attached to U-shaped supporting arms 32 mounted pivotably, in such a way that, as a result of pivoting movements, the supporting fingers 30, 31 can be moved into the region of the conveying tower 24 or retracted out of this region, the latter being for the purpose of introducing a subsequent pack 10. During this operation, the packs 10 already located in the conveying tower 24 are lifted by an amount corresponding to one pack 10.

At the top end of the conveying tower 24, the packs 10 enter the region of a horizontal pack track 33. This consists essentially of a lower central supporting rail 34 of less width than the dimension of the transverse packs 10. These are conveyed on the supporting rail 34 in an intermittent sliding manner. Stationary side walls 35, 36 are arranged in a part region of the pack track 33. The top side of the packs 10 resting on top of one another in pairs is also guided. Two vertical guide webs 37, 38 arranged at a distance from one another extend, adjacent to the end faces 12, 13 of the packs 10, on the top side of the latter in the conveying direction. Arranged approximately centrally between them is a brush 39 which extends over a relatively long region of the pack track 33 and which functions as a sliding abutment for the upper layer of packs 10. Thus, the top side of the upper packs 10 is also exposed to frictional stress during transport, in a similar way to the lower packs 10 resting with their underside on the supporting rail 34.

The packs 10 resting on top of one another in pairs are moved further in the region of the pack track 33 by means of a slide 40 movable to and fro in a horizontal plane. This grasps the two upper packs 10 inside the conveying tower 24 and moves them in the conveying direction shown on the pack track 33 or the supporting rail 34.

The folding tabs of the outer wrapping, in particular the tubular tabs formed on the side face 11 and the folding tabs 14 to 17 in the region of the end faces 12 and 13, after being completed, are connected to one another by means of sealing, that is to say as a result of the application of heat and pressure.

Figure 4:
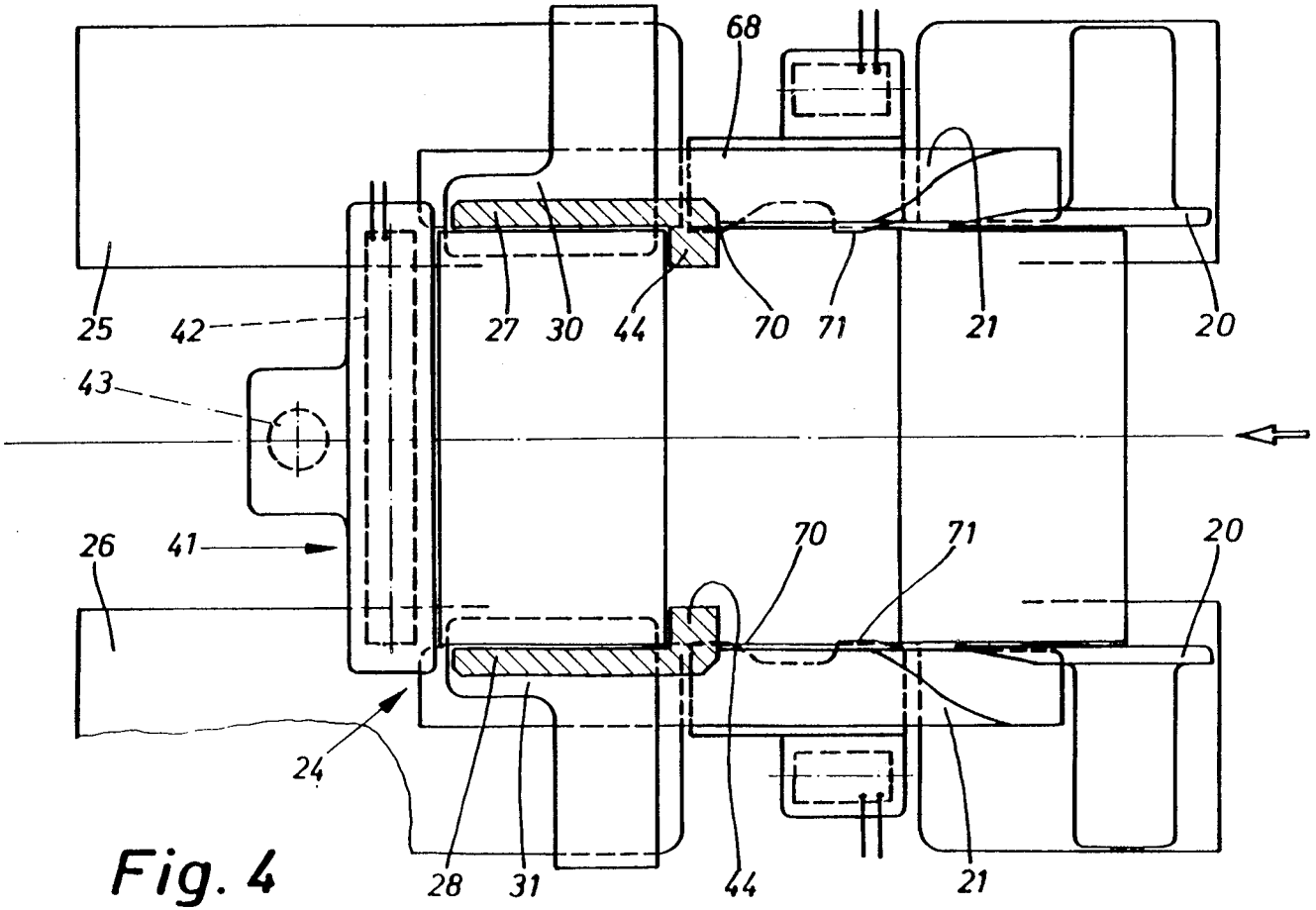
FIG. 4 shows a horizontal section along the plane IV—IV in FIG. 1.

The sealing of the tubular tabs on the side face 11 is carried out in the region of the conveying tower 24. Arranged transversely relative to the guide walls 27, 28, particularly in the region of the side faces 11, is a sealing member in the form of a vertical sealing jaw 41. This extends over the entire length of the side faces 11 and consequently over the entire width of the conveying tower 24 (FIG. 4) and over a height of several, in this case four, packs 10 within the conveying tower 24. The essentially plate-shaped sealing jaw 41 is equipped with (electrical) heating cartridges 42. Via an actuating rod 42 attached to the free rear side, the sealing jaw 41 can be moved transversely relative to the packs 10 or to their side faces 11.

The sealing jaw 41 executes a sealing cycle during each of the standstill phases of the packs 10 in the conveying tower 24 and is accordingly pressed (briefly) against the side faces 11. The upward movement of the packs 10, that is to say the conveying cycle, takes place when the sealing jaw 41 is in a retracted relieving position. However, during the transport movement of the packs 10 it is lifted off from the side faces 11 only slightly. The (pulsating) stroke of the sealing jaw 41 mounts to approximately 1 mm. In view of the fact that the packs 10 are deformable to a certain extent, even during the conveying movement, that is to say with the sealing jaw 41 retracted, they rest against the latter. The sealing jaw 41 thereby smooths the film or the tubular tabs and also continues the sealing action.

On the side opposite the sealing jaw 41 there are vertical marginal holding webs 44 connected to the guide walls 27, 28, as a further limitation of the conveying tower 24.

The packs 10 entering the region of the (horizontal) pack track 33 in succession are ready-sealed as regards their tubular tabs. For the end-face folding tabs 14 to 17, sealing members are arranged in the region of the pack track 33 on both sides of this.

Each sealing jaw 45, 46 with the heating cartridges 47 extends, as a lateral limitation of the pack track 33, over a length of several packs 10 in the conveying direction, in the present case over three pairs. The height of the sealing jaws 45, 46 corresponds to the height of the two packs 10 above one another. The sealing jaws 45, 46 extend into the region above the conveying tower 24, so that the packs 10 moved upwards, when they leave the conveying tower 24, enter immediately between the sealing jaws 45 and 46 equipped, in this region, with a lower runin portion. Sealing therefore begins as early as during the upward movement.

In the region which follows in the conveying direction of the pack track 33, the sealing jaws 45, 46 are designed in such a way, in particular are equipped, on the sides facing the packs 10 (end faces 12, 13), with elevations 48, 49 forming the actual sealing faces 50. The elevations 48, 49 or their sealing faces 50 have a smaller dimension (width and height) than the end faces 12, 13 of the packs 10. This ensures that the sealing faces 50 of the elevations 48, 49 do not come to rest in the region of the dimensionally stable edges of the packs 10. The elevations 48, 49 are provided all-round with chamfers 51, 52. The (vertical) chamfer 52 on the entry side of the packs 10 in the region of the elevations 48, 49 is elongate and tapers obliquely, thus guaranteeing a faultless run-in.

The sealing jaws 45, 46 are likewise moved intermittently up against the associated (six) packs 10, thereby exerting the necessary sealing pressure. This sealing cycle takes place during the standstill phase of the packs 10. For the further transport of these, the sealing jaws 45, 46 are lifted off from the end faces 12, 13 slightly (a stroke of approximately 1 mm). This ensures that the packs 10 can be moved further without disturbance, but their end faces 12, 13 or their folding tabs 14 to 17 continue to rest slidably on the sealing faces 50. Thus, heat and (relatively slight) pressure exerting a smoothing effect on the folding tabs are transmitted during conveyance.

In the present case, actuating rods 53 which are subjected to pressure by means of a suitable actuating member (pressure-medium cylinder) are attached to the sealing jaws.

The sealed packs 10 coming out of the region of the sealing jaws 45, 46 pass, in the region of the pack track 33, through the section for cooling and stabilizing the seal. Here, the packs 10 are guided laterally by the stationary side walls 35, 36 of the pack track 33. This is followed by a station, in which the packs, during the standstill, are separated from one another as a result of a transversely directed relative movement, in so far as adhesive bonds between adjacent packs have occurred a a result of the sealing. Both the two packs resting on top of one another and adjacent pairs of packs are shifted relative to one another.

For this purpose, arranged laterally next to the pack track 33 are specially shaped shifting plates 55 and 56 movable transversely relative to the conveying direction. During the standstill phase, these come to rest against the end faces 12 and 13 of every two successive pairs of packs 10. To this end, the shifting plates 55, 56 are movable to and fro by means of rams 57.

Pressure faces turned towards the packs 10 are designed in a special way. One shifting plate 55 is equipped, in a region located at the rear in the conveying direction, with a step-shaped double projection 58 and, following this in the conveying direction, with a set-back portion 59. The double projection 58 forms an offset 60 also in terms of height, so that two pressure faces 61, 62 are arranged offset relative to one another in this region, each being assigned to one of the packs 10 resting on top of one another (FIGS. 8 and 9).

The shifting plate 56 on the opposite side of the pack track 33 is of matching design. Accordingly, in the region of the double projection 58 of the shifting plate 55, the shifting plate 56 is equipped with a double set-back portion 54 likewise having two pressure faces 63 and 64 which are separated from one another by means of an offset 65. This is directed oppositely to the offset 60 so that the pressure face 61 is arranged to project, whereas the opposite pressure face 63 is in a set-back plane. On the other hand, the pressure face 62 is set-back, whilst the pressure face 64 projects correspondingly. As a result of this design of the shifting plates 55, 56 in the region of a group of (two) packs which is located at the rear in the conveying direction, a relative shift of these packs resting on top of one another is brought about when they are subjected to pressure by the shifting plates 55, 56 (FIG. 8).

A region of the shifting plates 55, 56 which follows in the conveying direction performs an aligning function for the packs shifted relative to one another during the preceding work cycle. For this purpose, the shifting plate 55 is equipped, in this region with a setback portion 59 which is made smooth or step-free over the full height (two packs), but which is set-back both relative to the pressure face 61 and relative to the pressure face 62. On the opposite side, the shifting plate 56 is equipped with a projecting portion 66 which is likewise made smooth or step-free.

Figure 8:
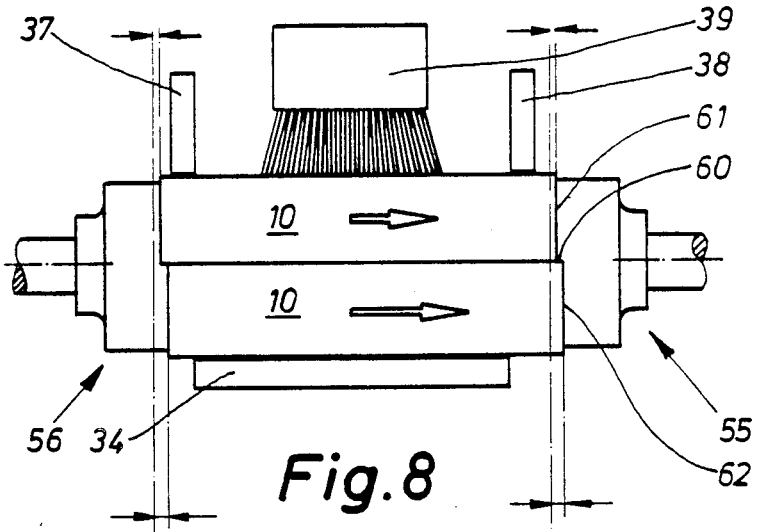
FIG. 8 shows a cross-section in the region of the detail according to FIG. 7.
Figure 9:
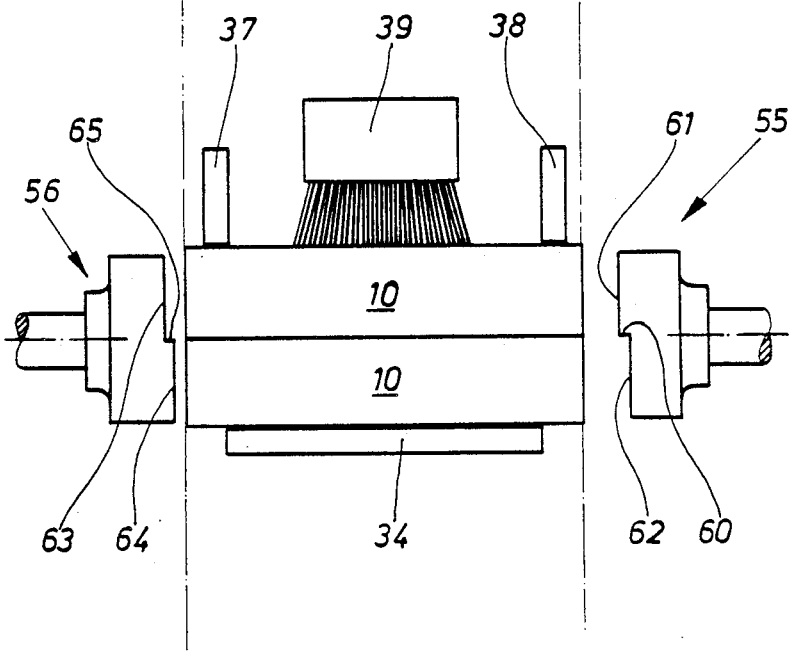
FIG. 9 shows the detail according to FIG. 8 in a changed relative position.

The individual faces of the various regions of the shifting plates 55, 56 are coordinated with one another in terms of their position, in such a way that, during a working stroke of the shifting plates 55, 56 relative to one another or towards the end faces of the packs in the region of the double projection 58 and of the double set-back portion 54, the two packs resting on top of one another are shifted both relative to one another and relative to the adjacent packs (the position according to FIG. 8). At the same time, the packs previously brought into this relative position are shifted relative to one another in the region of the set-back portion 59 and projecting portion 66, in such a way that they are aligned again. At the same time, the two packs are aligned with the pack track 33 and therefore with the packs conveyed further.

To obtain especially accurate folds and seals, the apparatus is equipped with devices for presealing the folding tabs in the region of the end faces 12, 13, so that before folding is completed the tabs folded first are fixed in position. In the present case, this means the fixing of the inner longitudinal tab 16 folded first. This is sealed to the already previously folded side tabs 14, 15 by means of two sealing spots 67, 68.

In the present example, the rectangular sealing spots 67, 68 are made by sealing members which are arranged in the region of the conveyor track 18 on both sides of this. The folding switches 21, as a lateral limitation of the conveyor track 18, are provided with passages 69 in the form of an elongate orifice. Sealing members, in particular two sealing pins 70, 71, pass through this and up against the end faces 12, 13 of the packs 10 and consequently against the (triangular) region of the longitudinal tabs 16.

Figure 5:
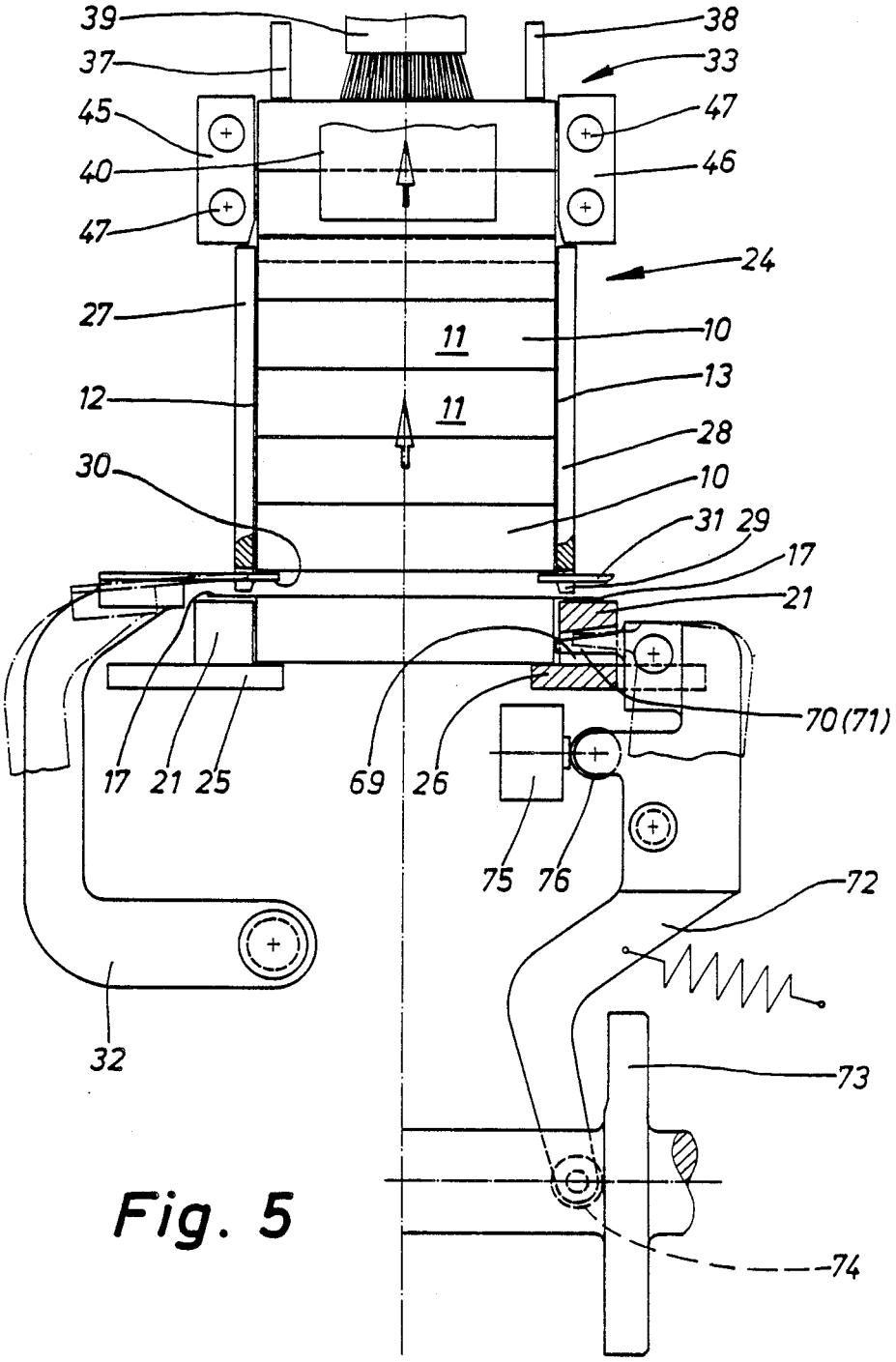
FIG. 5 shows a view of part of the apparatus in a plane transverse relative to the illustration in FIG. 1.
Figure 6:
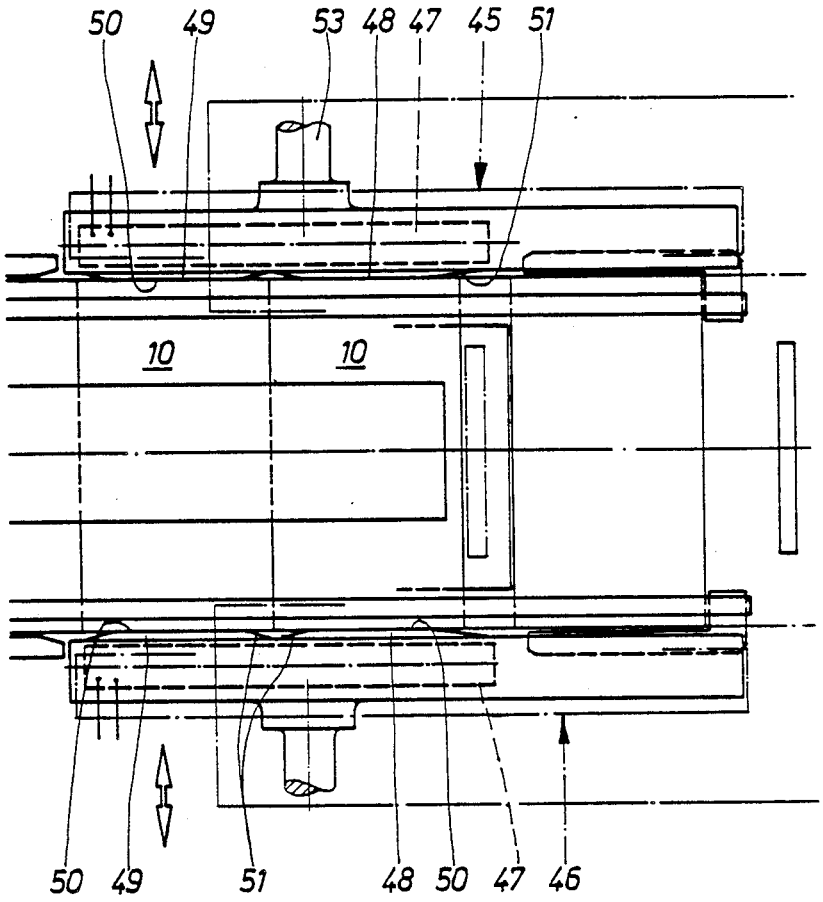
FIG. 6 shows a detail of the plan view according to FIG. 2 on an enlarged scale.
Figure 7:
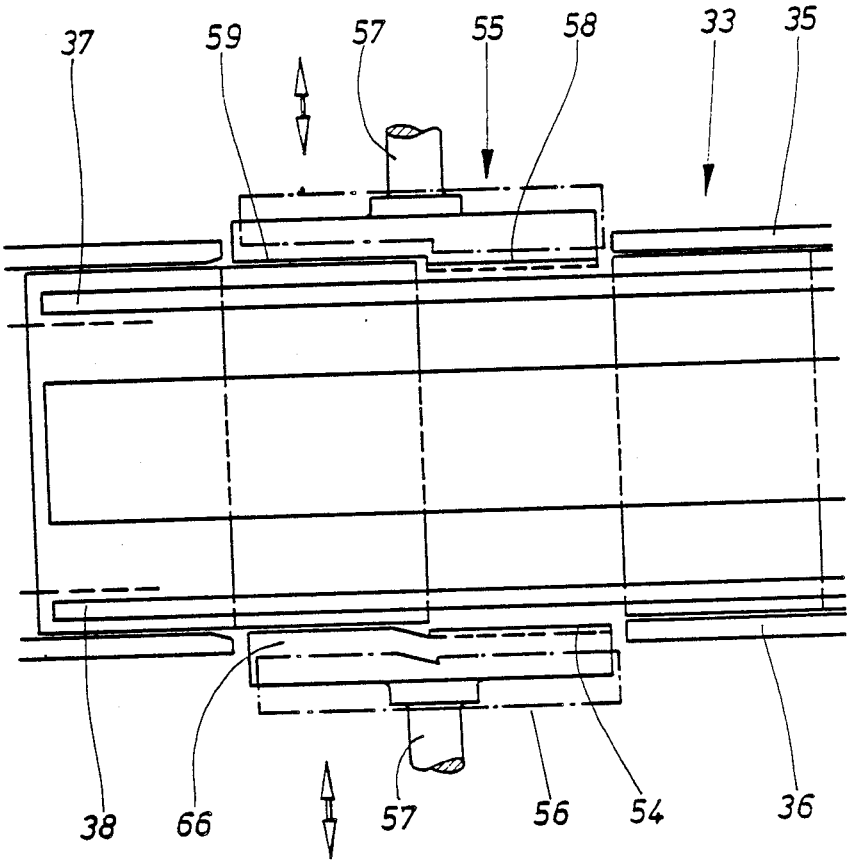
FIG. 7 shows a further cut-out from the illustration according to FIG. 2, likewise on an enlarged scale.

The heated sealing pins 70, 71 are arranged on a common holder 72 in the form of a two-armed pivotable lever. This is actuated via a tracer roller 74 by means of a continuous cam disc 73 (cup cam). The sealing pins 70, 71 also execute a relatively short working stroke. During the periodic standstill of the apparatus, the sealing pins 70, 71 are moved into a clearly retracted position (represented by dot-and-dashed lines in Figure 5), specifically by means of a pneumatic cylinder 75, the piston rod of which acts in the lifting-off direction on the holder 72 via a transmission roller 76.

I claim:

1. Process for sealing folding tabs of a pack, wrapped in a sealable blank, by means of heated sealing members which, during a standstill phase of the packs conveyed intermittently, can be pressed in a sealing position against the packs in the region of the folding tabs during a sealing cycle, characterized in that at least the transmission of heat to the folding tabs (14 to 17) is maintained between the sealing cycles, during the transport of the packs (10); and in that folding tabs, in the form of inner longitudinal tabs (16) folded first, are presealed before entering the region of the sealing members by being attached at certain points to other regions of the blank.

2. Process according to claim 1, characterized in that, between the sealing cycles, the sealing members (41; 45, 46) rest with reduced pressure against the packs (10) in the region of the folding tabs, in such a way that the folding tabs, without changing their relative position, slide along on the sealing members during transport in a smoothing position of the sealing members.

3. Process according to claim 1 o 2, characterized in that the sealing members (41; 45, 46) execute a stroke of approximately 1 mm between the sealing position and the smoothing position.

4. Process for sealing folding tabs of a pack, wrapped in a sealable blank, by means of heated sealing members which, during a standstill phase of the packs conveyed intermittently, can be pressed in a sealing position against the packs in the region of the folding tabs during a sealing cycle, characterized in that at least the transmission of heat to the folding tabs (14 to 17) is maintained between the sealing cycles, during the transport of the packs (10); and in that the packs (10) conveyed in close succession are briefly shifted relative to one another in the region of a pack track (33), in order to separate the packs (10) from one another, as a result of a brief relative shift transverse to the conveying direction.

5. Process for sealing folding tabs of a pack, wrapped in a sealable blank, by means of heated sealing members which, during a standstill phase of the packs conveyed intermittently, can be pressed in a sealing position against the packs in the region of the folding tabs during a sealing cycle, characterized in that at least the transmission of heat to the folding tabs (14 to 17) is maintained between the sealing cycles, during the transport of the packs (10); and in that the packs (10) conveyed upwards in stages are sealed in the region of tubular tabs of the blank by means of a vertical sealing member (41) arranged on one side.

6. Apparatus for sealing folding tabs of a pack wrapped in a sealable blank, by means of heated sealing members which, during a standstill phase of the packs conveyed intermittently, can be pressed in a sealing position against the packs in the region of the folding tabs during a sealing cycle, characterized in that the sealing members are sealing jaws (41; 45, 46) which can be moved back into an initial smoothing position, in which the heated sealing members rest with substantially pressureless contact against the folding tabs (14 to 17) of the blank so that the folding flaps slide during transport along on the sealing members.

7. Apparatus according to claim 6, characterized in that a sealing jaw (41) for sealing tubular tabs of the blank is arranged in the region of a vertical conveying stage of the packs (10), as a lateral limitation of a conveying tower (24), the sealing jaw (41) having the height of several packs (10) arranged on top of one another.

8. Apparatus according to claim 6, characterized in that the sealing jaws (41; 45, 46) execute a stroke of approximately 1 mm transversely relative to the direction of transport of the packs (10).

9. Apparatus according to claim 7, characterized in that laterally directed folding tabs, in the form of side tabs (14, 15) and longitudinal tabs (16, 17), of the packs (10) can be sealed in the region of a horizontal pack track (33) by means of sealing jaws (45, 46) arranged on both sides of the latter.

10. Apparatus according to claim 9, characterized in that the sealing jaws (45, 46), on the side facing the packs (10), are equipped, at least in the regions next to the conveying tower (24), with elevations (48, 49) which have projecting sealing faces (50) for resting against end faces (12, 13) of the packs (10), the sealing faces (50) assigned to each pack (10) or end face (12, 13) being smaller than the end faces (12, 13).

11. Apparatus according to claim 9, characterized in that the sealing jaws (45, 46) extend into the region of the conveying tower (24) or above this, in the conveying direction of the packs (10), over a length of several packs (10) located next to one another, and the packs (10) can be conveyed out of the conveying tower (24) from below, between the sealing jaws (45, 46).

12. Apparatus according to claim 10, characterized in that, after sealing, the packs (10) can be shifted, in the region of the horizontal pack track (33), by means of pressure members movable transversely relative to the conveying direction.

13. Apparatus according to claim 10, characterized in that the elevations (48, 49) of the sealing jaws (45, 46) are provided with chamfers (51, 52) surrounding the sealing faces (50).

14. Apparatus according to claim 10, characterized in that the inner longitudinal tabs (16), can be presealed in the region of the end faces (12, 13) of the packs (10) before entering the conveying tower (24), in the region of a horizontal conveyor track (18), by means of sealing members (70, 71), especially by the provision of sealing spots (67, 68) in the region of the overlap of the inner longitudinal tabs (16) with the side tabs (14, 15).

15. Apparatus according to claim 14, characterized in that arranged in the region of the conveyor track (18) are sealing members movable intermittently transversely relative to the conveying direction, each with two heated sealing pins (70, 71) which are arranged at a distance from one another and which can be moved up against the end faces (12, 13) in the region of the folded inner longitudinal tab (16) during a standstill phase of the packs (10).

16. Apparatus according to claim 15, characterized in that the sealing members for presealing, especially the sealing pins (70, 71), can be moved in the region of lateral folding members, in the form of folding switches (21), through an orifice or a passage (69) in the folding members and up against the end faces (12, 13).

17. Apparatus according to claim 12, characterized by at least one shifting plate (55, 56) on each of the two sides of the packs (10) arranged in pairs on top of one another, the shifting plates (55, 56) having offset pressure faces (61, 62; 63, 64), two for each pack (10), which match one another in such a way that, when the end faces (12, 13) are subjected to pressure, the packs (10) resting on top of one another can be shifted relative to one another and relative to adjacent packs (10).

18. Apparatus according to claim 17, characterized in that, following the pressure faces (61 to 64), arranged above one another in pairs, in the conveying direction, the shifting plates (55, 56) are designed with a mutually matching set-back portion (59) (shifting plate 55) and projecting portion (66) (shifting plate 56), the set-back portion (59) and projecting portion (66) being arranged in such a way that, in the region of these, the packs (10) are aligned relative to one another and relative to the packs (10) conveyed further.

19. Process for sealing folding tabs of a pack, wrapped in a sealable blank, by means of heated sealing members which, during a standstill phase of the packs conveyed intermittently, can be pressed in a sealing position against the packs in the region of the folding tabs during a sealing cycle, characterized in that at least the transmission of heat to the folding tabs (14 to 17) is maintained between the sealing cycles, during the transport of the packs (10); and in that between the sealing cycles, the sealing members (41: 45, 46) rest with substantially pressureless contact against the packs (10) in the region of the folding tabs, in such a way that the folding tabs, without changing their relative position, slide along on the sealing members during transport in a smoothing position of the sealing members.

20. Process according to claim 19, characterized in that the packs (10) conveyed in close succession are briefly shifted relative to one another in the region of a pack track (33), in order to separate the packs (10) from one another, as a result of a brief relative shift transverse to the conveying direction.

21. Process according to claim 19, characterized in that the sealing members (41: 45, 46) execute a stroke of approximately 1 mm between the sealing position and the smoothing position.

22. Process according to claim 19, characterized in that folding tabs, in the form of inner longitudinal tabs (16) folded first, are presealed before entering the region of the sealing members by being attached at certain points to other regions of the blank.

23. Process according to claim 19, characterized in that the packs (10) conveyed upwards in stages are sealed in the region of tubular tabs of the blank by means of a vertical sealing member (41) arranged on one side.

* * * * *